US010980390B2

(12) United States Patent
Zhang

(10) Patent No.: US 10,980,390 B2
(45) Date of Patent: Apr. 20, 2021

(54) MOP CLEANING DEVICE WITH CLEANING TUB CAPABLE OF RISING AND FALLING

(71) Applicant: JIAXING JACKSON TRAVEL PRODUCTS CO., LTD, Jiaxing (CN)

(72) Inventor: Juhong Zhang, Jiaxing (CN)

(73) Assignee: JIAXING JACKSON TRAVEL PRODUCTS CO., LTD., Jiaxing (CN)

( * ) Notice: Subject to any disclaimer, the term of this patent is extended or adjusted under 35 U.S.C. 154(b) by 0 days.

(21) Appl. No.: 16/961,937

(22) PCT Filed: Jan. 17, 2019

(86) PCT No.: PCT/CN2019/072062

§ 371 (c)(1),
(2) Date: Jul. 14, 2020

(87) PCT Pub. No.: WO2019/149075

PCT Pub. Date: Aug. 8, 2019

(65) Prior Publication Data

US 2020/0383552 A1 Dec. 10, 2020

(30) Foreign Application Priority Data

Feb. 2, 2018 (CN) ..... 201820184901.4

(51) Int. Cl.
*A47L 13/59* (2006.01)
*A47L 13/20* (2006.01)

(52) U.S. Cl.
CPC ..... *A47L 13/59* (2013.01); *A47L 13/20* (2013.01)

(58) Field of Classification Search
CPC ..... A47L 13/20; A47L 13/59
See application file for complete search history.

(56) References Cited

U.S. PATENT DOCUMENTS

| | | | | |
|---|---|---|---|---|
| 2,127,045 | A * | 8/1938 | Pavek | A47L 13/59 15/261 |
| 5,615,446 | A * | 4/1997 | Cetnarowski | A47L 13/59 100/131 |
| 9,474,429 | B2 * | 10/2016 | Kepner | A47L 13/58 |
| 2005/0204503 | A1 * | 9/2005 | Burns | A47L 13/59 15/261 |
| 2013/0139848 | A1 | 6/2013 | Goentzel | |

FOREIGN PATENT DOCUMENTS

| | | | |
|---|---|---|---|
| CN | 203953581 | U | 11/2014 |
| CN | 206227129 | U | 6/2017 |
| CN | 107334434 | A | 11/2017 |
| CN | 107456180 | A | 12/2017 |
| JP | H09313414 | A | 12/1997 |

* cited by examiner

*Primary Examiner* — Randall E Chin
(74) *Attorney, Agent, or Firm* — Bayramoglu Law Offices LLC

(57) ABSTRACT

A mop cleaning device with an adjustable cleaning tub includes a water wiper, a big container, a small container, and a lifting mechanism arranged between the big container and the small container. The small container is able to rise and fall with respect to the big container by means of the lifting mechanism. When the small container is located at a low position, the water level in the big container is higher than water inlets of the small container. When the small container is located at a high position, the water level in the big container is lower than the water inlets of the small container. The water wiper is arranged in the big container and/or the small container.

10 Claims, 6 Drawing Sheets

MOP CLEANING DEVICE WITH CLEANING TUB CAPABLE OF RISING AND FALLING

CROSS-REFERENCE TO THE RELATED APPLICATIONS

This application is the national stage entry of International Application No. PCT/CN2019/072062, filed on Jan. 17, 2019, which is based upon and claims priority to Chinese Patent Application No. 201820184901.4, filed on Feb. 2, 2018, the entire contents of which are incorporated herein by reference.

TECHNICAL FIELD

The utility model relates to a mop cleaning device with a cleaning tub capable of rising and falling, and belongs to the technical field of cleaning articles.

BACKGROUND

Chinese Invention Patent Publication No. CN107456180A discloses a squeezing-type flat mop cleaning tool, which comprises a mop tub and a flat mop, wherein the flat mop comprises a mop rod and a flat mop head movably connected to the mop rod, and a wiper is arranged on the flat mop head; the mop tub has a separated water squeezing area and a separated cleaning area, and the water squeezing area and the cleaning area are respectively located at two different positions; an open squeezing device is mounted on the mop tub; during cleaning and water squeezing, the flat mop head can be rotated to be in a cleaning and water-squeezing state and is maintained in the cleaning and water-squeezing state by means of a positioning device between the flat mop head and the mop rod; and during moping, the flat mop head gets rid of control of the positioning device to be rotated to be in a mopping state.

When the squeezing-type flat mop cleaning device in the abovementioned technical solution is used to clean the mop, the mop needs to be transferred from the cleaning area to the water squeezing area, and in this process, water may splash out, thus causing secondary pollution to the floor.

SUMMARY

The objective of the utility model is to overcome the defects of the prior art by providing a mop cleaning device with a cleaning tub capable of rising and falling, which is reasonable in structural design and can fulfill cleaning and water squeezing.

The technical solution adopted by the utility model to solve the abovementioned problems is as follows: a mop cleaning device with a cleaning tub capable of rising or falling comprises a water wiper, a big container, a small container, and a lifting mechanism arranged between the big container and the small container, wherein the small container is able to rise and fall with respect to the big container by means of the lifting mechanism; when the small container is located at a low position, the water level in the big container is higher than a water inlet of the small container; when the small container is located at a high position, the water level in the big container is lower than the water inlet of the small container; and the water wiper is arranged in the big container or/and the small container.

Furthermore, the small container is arranged in the big container.

Furthermore, the small container is communicated with the big container by means of a hose.

Furthermore, the lifting mechanism comprises a slope which is fixedly arranged with respect to the big container, and a sliding column arranged on the small container and located on the slope.

Furthermore, the water wiper and a water outlet are arranged at an open end of the small container, the angle between the water wiper and a horizontal line is an obtuse angle, and the water wiper is arranged at the water outlet.

Furthermore, sliding grooves are formed in the small container, two ends of the water wiper are arranged in the sliding grooves, and the sliding grooves are slant to ensure that a mop is located close to lower sides of the sliding grooves.

Furthermore, the open end of the small container has an inclined plane capable of expanding an opening, the water outlet is formed in the inclined plane, and the water wiper is disposed above the water outlet.

Furthermore, the slope is cyclically undulant around the big container.

Furthermore, the slope is a tilted slot.

Compared with the prior art, the utility model has the following advantages and effects: when the mop cleaning device of the utility model is used, the mop can be cleaned and spin-dried in the same area; compared with the prior art, the position of the mop does not need to be changed, so that the mop cleaning device of the utility model has the advantages of convenient operation, efficient cleaning, and the like.

Description of the numerals are: 1, big container; 11, slope; 2, small container; 20, water inlet; 20', water outlet; 21, sliding groove; 22, sliding column; 3, water wiper; and 4, mop head.

DETAILED DESCRIPTION OF THE EMBODIMENTS

The utility model is further expounded below in conjunction with the accompanying drawings and embodiments. The following embodiments are merely used to explain the utility model, and are not intended to limit the utility model.

Embodiment 1

Figure 1:
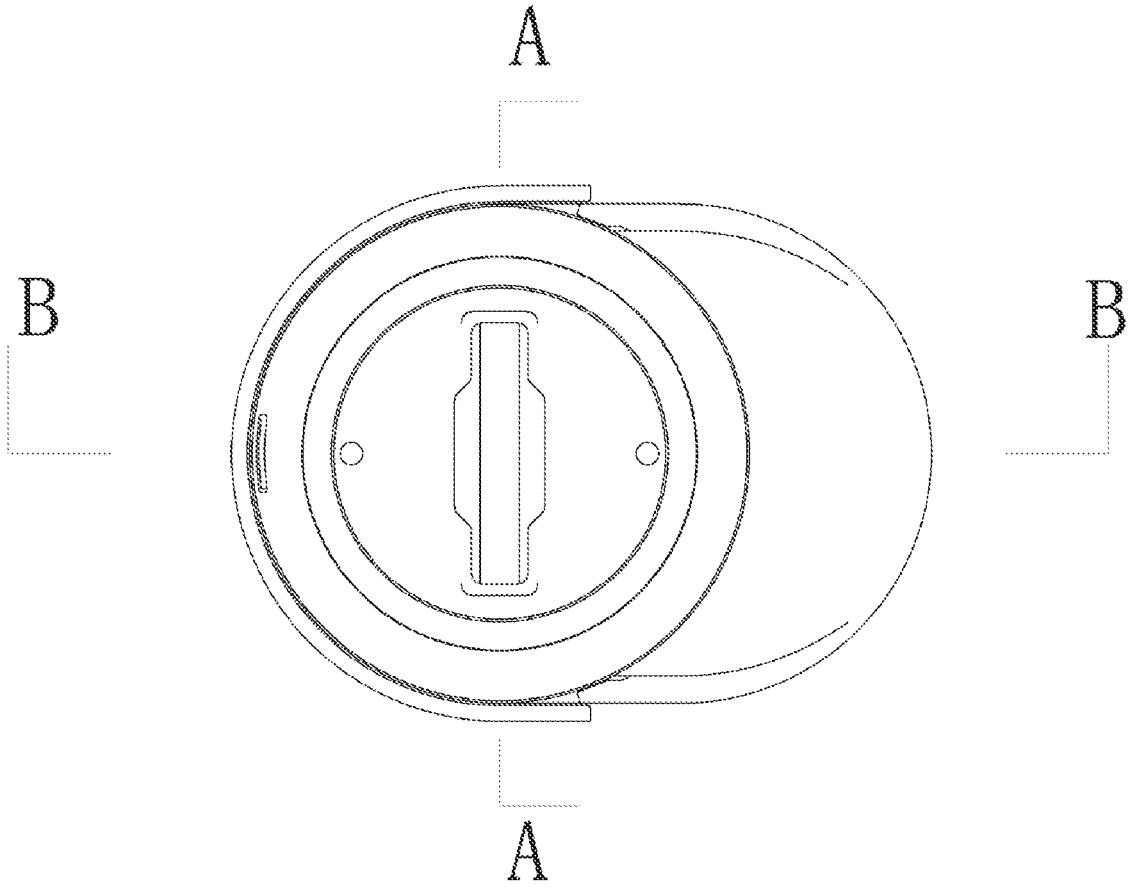
FIG. 1 is a structural view of this embodiment.
Figure 2:
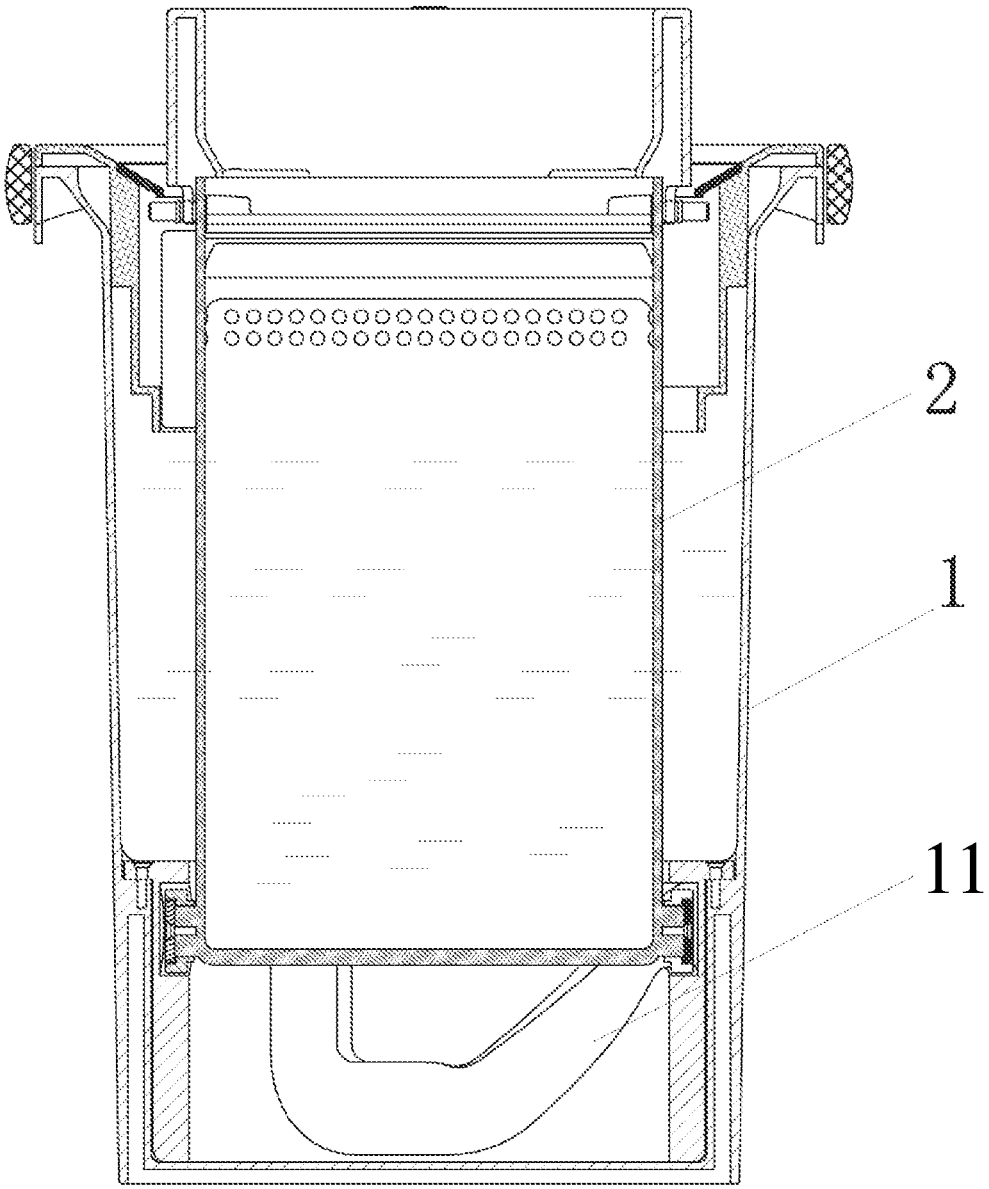
FIG. 2 is a sectional structural view along A-A in FIG. 1.
Figure 3:
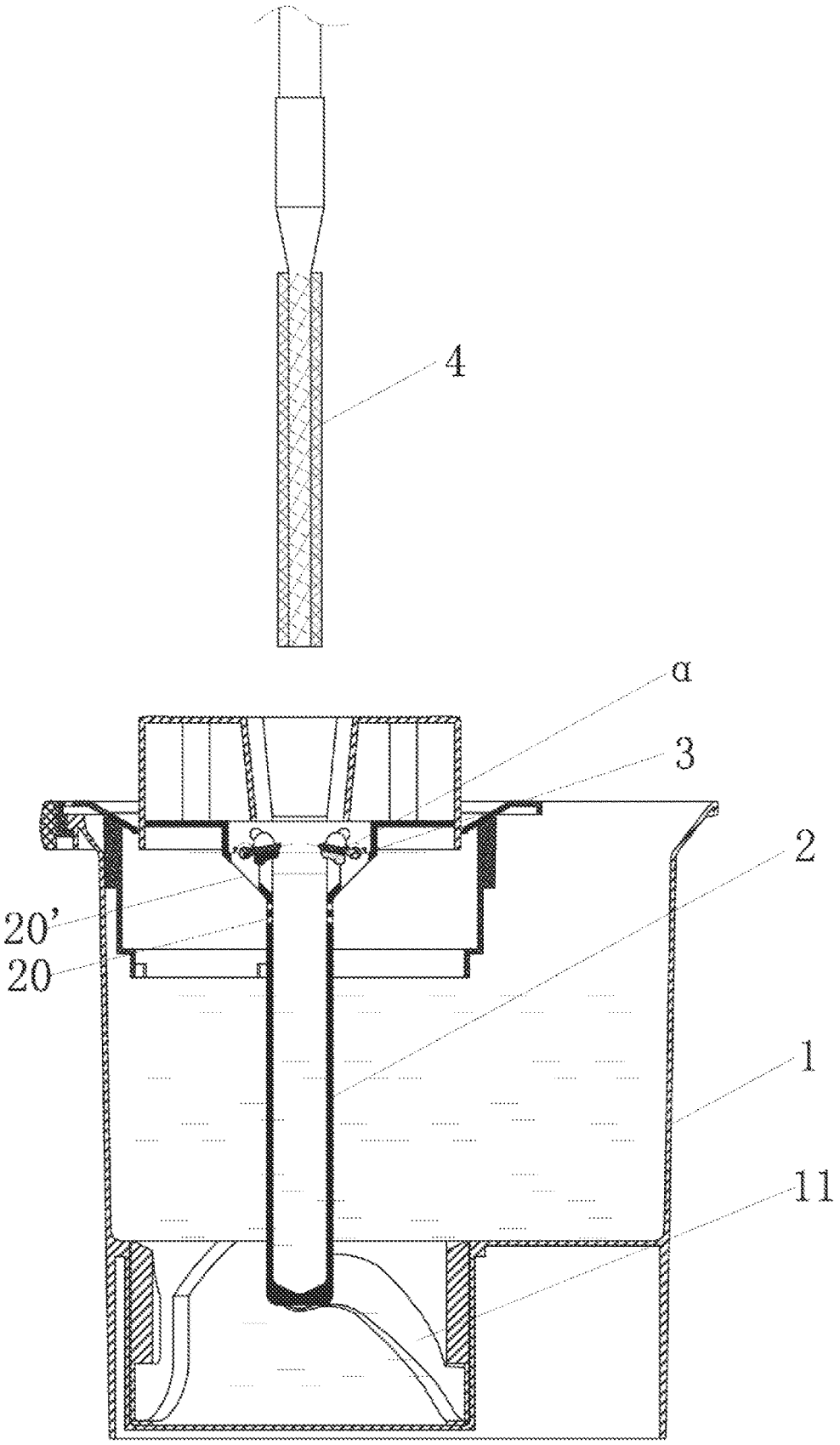
FIG. 3 is a sectional structural view along B-B in FIG. 1.
Figure 4:
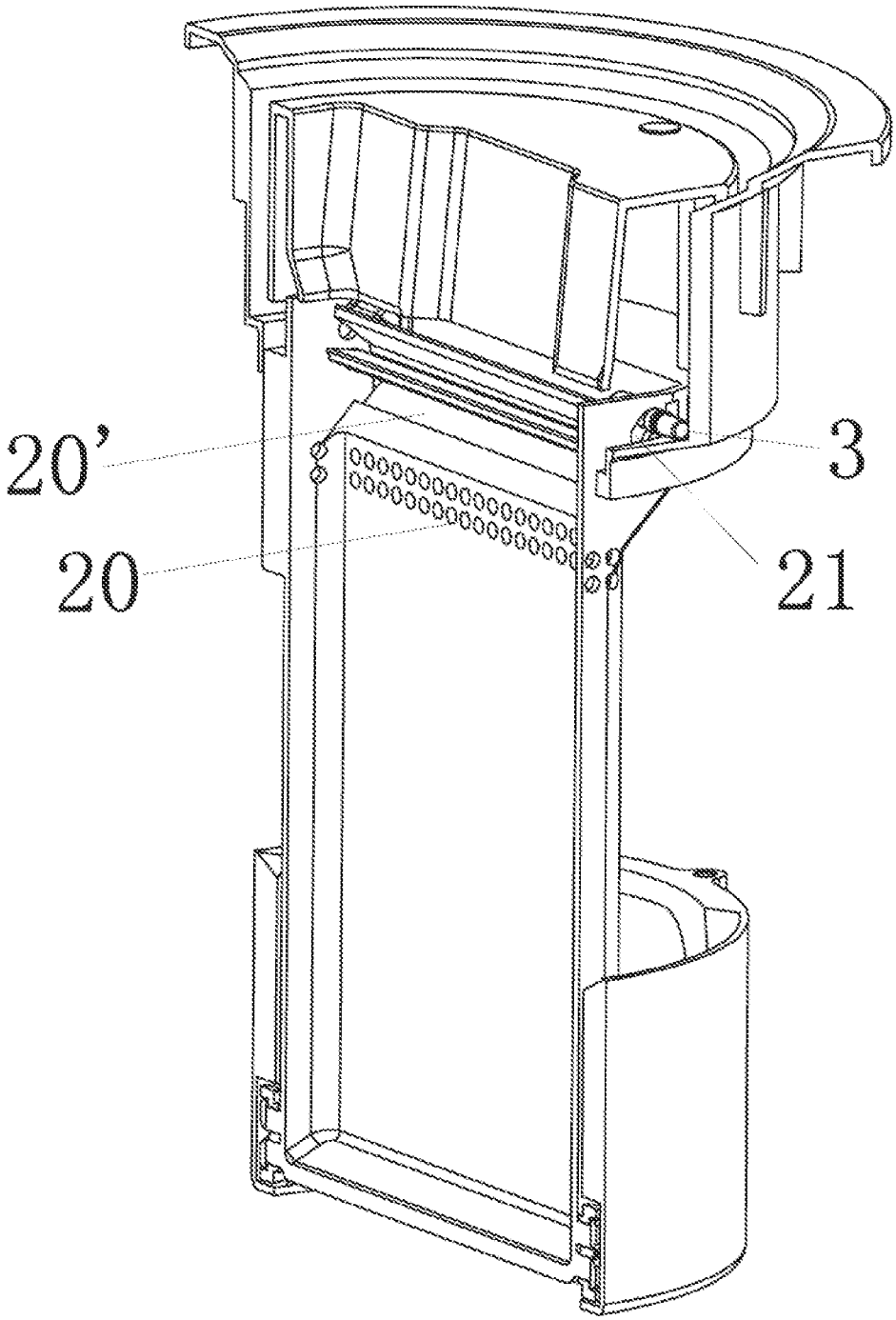
FIG. 4 is a structural view of this embodiment when a small container is located at a low position.
Figure 5:
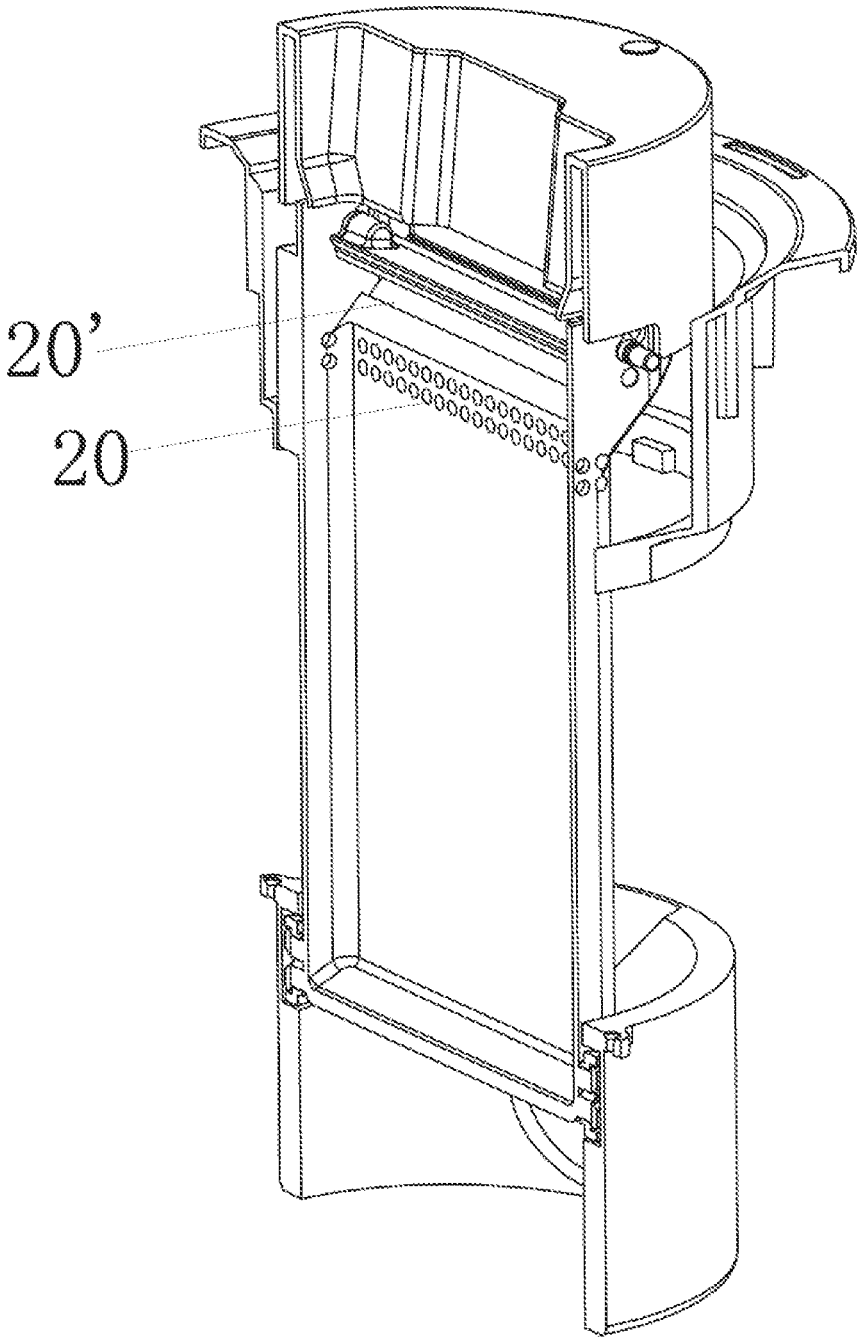
FIG. 5 is a structural view of this embodiment when the small container is located at a high position.
Figure 6:
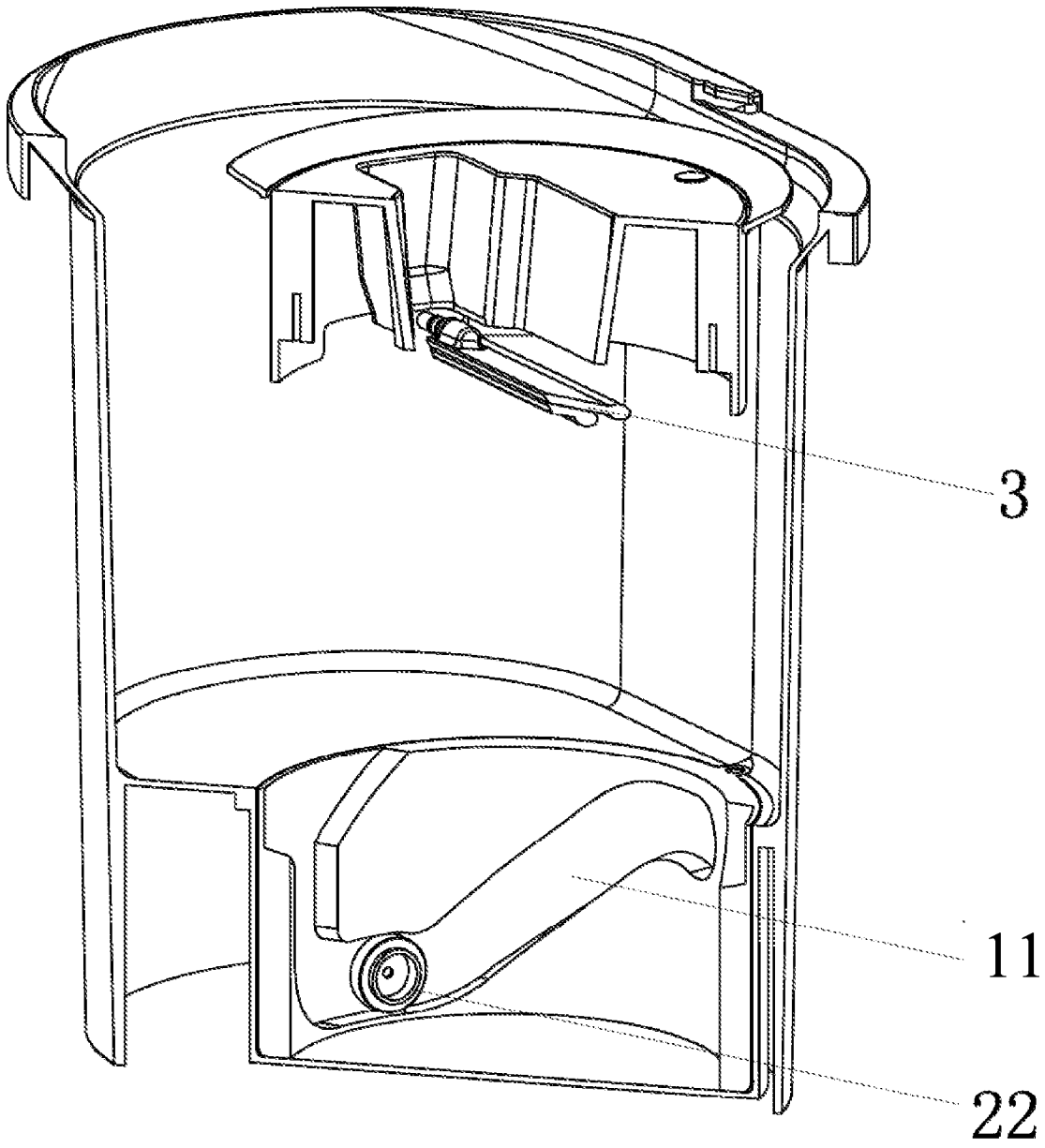
FIG. 6 is a structural view of a sliding column and a moving track of the sliding column on a slope in this embodiment.

As shown in FIG. 1 to FIG. 6, this embodiment provides a mop cleaning device with a cleaning tub capable of rising and falling, which comprises a big container 1, a small container 2, a water wiper 3, and a lifting mechanism arranged between the big container 1 and the small container 2, wherein the small container 2 is able to rise and fall with respect to the big container 1 by means of the lifting mechanism and is provided with water inlets 20; when the small container 2 is located at a low position, the water level in the big container 1 is higher than the water inlets 20 of the small container 2, and water from the big container 1 is injected into the small container 2; when the small container 2 is located at a high position, the water level in the big container 1 is lower than the water inlets 20 of the small container 2, and water is stopped from being injected into the small container 2 from the big container 1; and at this moment, the small container 2 serves as a cleaning tub, a mop head 4 is soaked and cleaned in the small container 2, then water in the mop head 4 is wiped off by the water wiper 3 which is arranged in the big container 1 or the small container 2.

Preferably, in this embodiment, the small container 2 is arranged in the big container 1. When the small container 2 is located at a low position, water from the big container 1 is directly injected into the small container 2 via the water inlets 20.

In this embodiment, the lifting mechanism comprises a slope 11 which is fixedly arranged with respect to the big container 1, and a sliding column 22 arranged in the small container 2, wherein the sliding column 22 is disposed on the slope 11 and moves along a track defined by the slope 11, and when the small container 2 rotates, the sliding column 22 slides along the slope to rise and fall. A user stretches the mop head 4 into the small container 2 and then operates a mop rod to drive the small container 2 to rotate to rise and fall.

In this embodiment, the water wiper 3 and a water outlet 20' are arranged at an open end of the small container 2; an angle $\alpha$ between the water wiper 3 and a horizontal line is an obtuse angle, that is, the water wiper 3 inclines with respect to the horizontal direction; and when the mop head 4 moves downwards, water flows to the water outlet 20' along the upper surface of the water wiper 3. This structure can accelerate drainage.

In this embodiment, sliding grooves 21 are formed in the small container 2, the two ends of the water wiper 3 are arranged in the sliding grooves 21, and the sliding grooves 21 are slanted toward a position where the mop head 4 is located close to the lower sides of the sliding grooves 21. When the mop head 4 moves downwards, the water wiper 3 moves downwards along the sliding grooves 21 and presses against the mop head 4 to squeeze water out of the mop head 4. When the mop head 4 moves upwards, the water wiper 3 is driven by the friction of the mop head 4 to move upwards along the sliding grooves 21, so that the mop head 4 is cleaned and pulled upwards.

In this embodiment, the open end of the small container 2 has an inclined plane capable of expanding an opening, the water outlet 20' is formed in the oblique plane, and the water wiper 3 is disposed above the water outlet 20'. By arranging the inclined plane, the water wiper 3 and the water outlet 20' are layered in the vertical direction, and water flows from the water wiper 3 to the water outlet 20' from top to bottom. It should noted that in this embodiment, the water outlet 20' and the water inlets 20 are located at different positions, and may also be formed in the same position if necessary.

In this embodiment, the slope 11 is cyclically undulant around the big container 1. When the small container 2 cyclically rotates, the small container 2 can also cyclically rise and fall synchronously.

In this embodiment, the slope 11 is a tilted slot which has an upper flange and a lower flange, and the upper flange is used to limit the sliding column 22.

In this embodiment, in use, water is injected into the small container 2 from the big container 1 when the small container 2 is located at a low position, and then the mop rod is operated to enable the small container 2 to rotate; when the small container 2 rises to a high position, the mop head 4 absorbs water from the small container 2 and then moves with respect to the water wiper 3, which wipes off water in the mop head 4, so that the mop head is dried.

Embodiment 2

According to another implementation of the utility model, the small container 2 is communicated with the water inlets 20 of the big container 1 by means of a hose. When the small container 2 is located at a low position, water from the big container 1 is injected into the small container 2 via the hose. By adoption of this structure, the small container 2 may be arranged beside the big container 1.

The above contents in this specification are merely for an illustrative explanation of the utility model. Various modifications, supplements or similar substitutions to the specific embodiments described above can be made by those skilled in the art without departing from these contents or going beyond the scope defined by the appended claims, and all these modifications, supplements or similar substitutions should also fall within the protection scope of the utility model.

What is claimed is:

1. A mop cleaning device with a liftable cleaning tub, comprising:

a water wiper, a big container, a small container, and a lifting mechanism arranged between the big container and the small container, wherein the small container is configured to rise and fall with respect to the big container by the lifting mechanism;

when the small container is located at a low position, a water level in the big container is higher than a water inlet of the small container; when the small container is located at a high position, the water level in the big container is lower than the water inlet of the small container;

the water wiper is arranged in the big container and the small container, or the water wiper is arranged in the big container, or the water wiper is arranged in the small container.

2. The mop cleaning device according to claim 1, wherein the small container is arranged in the big container.

3. The mop cleaning device according to claim 1, wherein the small container is communicated with the big container by a hose.

4. The mop cleaning device according to claim 1, wherein the lifting mechanism comprises a slope, wherein the slope is fixedly arranged with respect to the big container, and a sliding column is arranged on the small container and located on the slope.

5. The mop cleaning device according to claim 4, wherein the slope is cyclically undulant around the big container.

6. The mop cleaning device according to claim 5, wherein the slope is a tilted slot.

7. The mop cleaning device according to claim 4, wherein the slope is a tilted slot.

8. The mop cleaning device according to claim 1, wherein the water wiper and a water outlet are arranged at an open end of the small container, an angle between the water wiper and a horizontal line is an obtuse angle, and the water wiper is arranged at the water outlet.

9. The mop cleaning device according to claim 8, wherein a plurality of sliding grooves are formed in the small container, two ends of the water wiper are arranged in the plurality of sliding grooves, and the plurality of sliding grooves are configured to be slanted toward a position where a mop head is located close to lower sides of the plurality of sliding grooves.

10. The mop cleaning device according to claim 8, wherein the open end of the small container has an inclined plane for expanding an opening, wherein the water outlet is formed in the inclined plane, and the water wiper is disposed above the water outlet.

* * * * *